US010003161B2

(12) United States Patent
Tsai et al.

(10) Patent No.: US 10,003,161 B2
(45) Date of Patent: Jun. 19, 2018

(54) ELECTRICAL CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Long-Fei Chen, New Taipei (TW); Yun-Jhong Wong, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days. days.

(21) Appl. No.: 15/420,687

(22) Filed: Jan. 31, 2017

(65) Prior Publication Data

US 2017/0222373 A1 Aug. 3, 2017

(30) Foreign Application Priority Data

Feb. 1, 2016 (CN) ..... 2016 2 0098309

(51) Int. Cl.

| | |
|---|---|
| ***H01R 13/6591*** | (2011.01) |
| ***H01R 13/6596*** | (2011.01) |
| ***H01R 13/6585*** | (2011.01) |
| ***H01R 13/6598*** | (2011.01) |
| ***H01R 24/60*** | (2011.01) |
| *H01R 4/64* | (2006.01) |

(52) U.S. Cl.

CPC ..... *H01R 13/6591* (2013.01); *H01R 13/6585* (2013.01); *H01R 13/6596* (2013.01); *H01R 13/6598* (2013.01); *H01R 24/60* (2013.01); *H01R 4/64* (2013.01)

(58) Field of Classification Search

CPC ..... H01R 13/6585; H01R 13/6591; H01R 13/6593; H01R 13/6596; H01R 13/6598; H01R 24/60

USPC ..... 439/607.04, 607.05, 607.27, 607.28, 439/607.3, 607.55

See application file for complete search history.

(56) References Cited

U.S. PATENT DOCUMENTS

| | | | | |
|---|---|---|---|---|
| 8,298,016 | B2 * | 10/2012 | Lai | H01R 13/6596 439/607.28 |
| 8,724,343 | B2 * | 5/2014 | Feldstein | H05K 9/0058 361/616 |
| 8,851,927 | B2 * | 10/2014 | Hsu | H01R 12/724 439/607.11 |
| 9,136,616 | B2 * | 9/2015 | Zhao | H01R 12/724 |
| 9,461,415 | B2 * | 10/2016 | Guo | H01R 13/41 |
| 9,768,544 | B2 * | 9/2017 | Du | H01R 13/521 |

(Continued)

*Primary Examiner* — Tulsidas C Patel
*Assistant Examiner* — Travis Chambers
(74) *Attorney, Agent, or Firm* — Muncy, Geissler, Olds & Lowe, P.C.

(57) ABSTRACT

An electrical connector includes a metallic shell structure having a port, an insulation housing disposed in the metallic shell structure, a shielding plate disposed inside the insulation housing, and two rows of conductive terminal sets disposed on the insulation housing with each on two opposing sides of the shielding plate. A conductive contact portion is formed around the port by the metallic shell structure. Therefore, as the electrical connector is assembled with an external device, the conductive contact portion can be in contact with the external device. Hence, a grounding effect is achieved, and an electromagnetic compatibility is improved.

15 Claims, 7 Drawing Sheets

(56) References Cited

U.S. PATENT DOCUMENTS

| | | | | |
|---|---|---|---|---|
| 2016/0033198 | A1* | 2/2016 | Hsiao | F26B 3/28<br>439/485 |
| 2016/0126677 | A1* | 5/2016 | Yu | H01R 13/6474<br>439/607.23 |

* cited by examiner

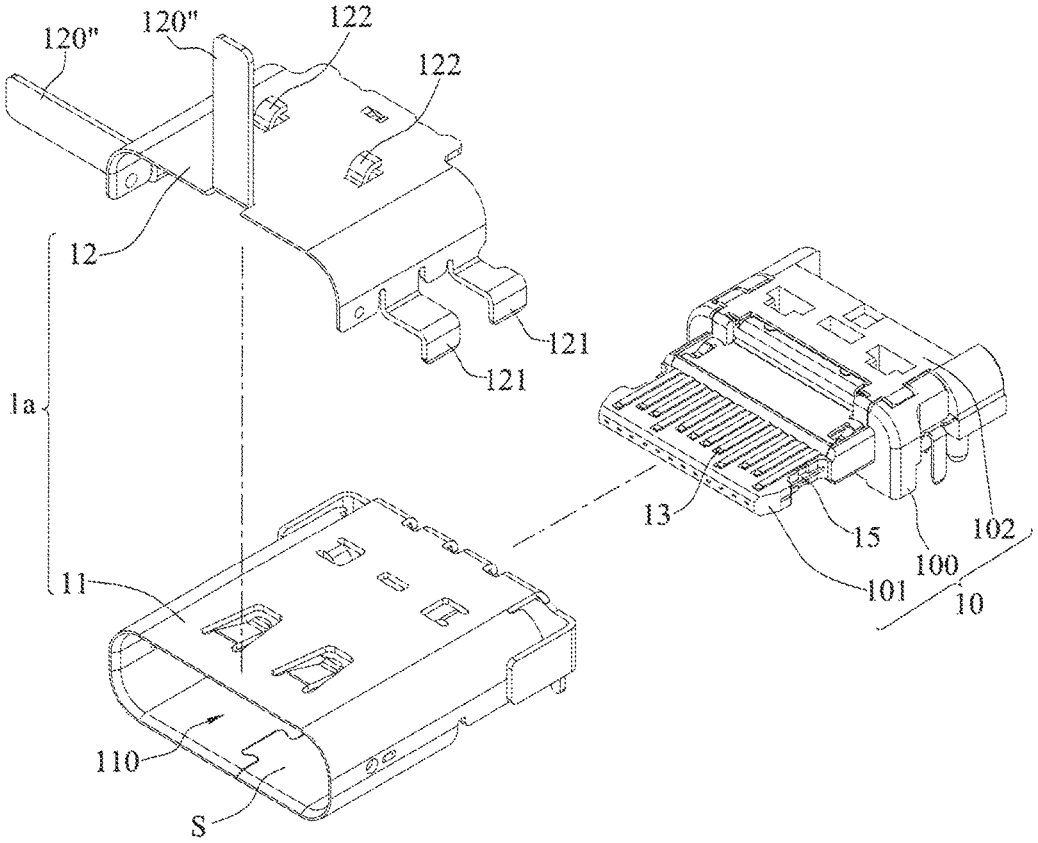
FIG. 3"

ELECTRICAL CONNECTOR

CROSS-REFERENCE TO RELATED APPLICATION(S)

This application claims priority to Chinese Patent Application No. 201620098309.3, filed on Feb. 1, 2016, the entirety of which is incorporated by reference herein.

BACKGROUND OF THE INVENTION

1. Technical Field

The instant disclosure relates to connectors, and, more particularly, to an electrical connector.

2. Description of the Prior Art

An electrical connector is a connection device that can be electrically connected to a wire, a circuit board or other electronic components, and can be widely applied to a variety of electronic products, such as computers, laptop computers, and cellular phones.

A metallic shell of a conventional electrical connector protects internal electronic components from damages. However, the metallic shell of the electrical connector has a poor shielding capability. As a result, the electrical connector is vulnerable to radio frequency interference (RFI), and an electronic product (such as a wireless mouse or a Bluetooth device) connected to the electronic connector cannot function normally.

Besides, as assembled with an external device, the metallic shell of the conventional electrical connector is not in contact with the external device. Therefore, electromagnetic compatibility (EMC) cannot be improved, and the electrical connector is likely affected by electromagnetic interference waves of the electronic product.

Therefore, how to solve the problems of the prior art is becoming an urgent issue in the art.

SUMMARY

In view of the drawbacks of the prior art, the instant disclosure provides an electrical connector, comprising: a metallic shell structure defining a receiving space and having a port and an opening in communication with the receiving space with one single conductive contact portion; an insulation housing disposed inside the receiving space of the metallic shell structure and having a base portion and a tongue portion extending from the base portion; a shielding plate disposed inside the insulation housing; and two rows of conductive terminal sets disposed on two sides of the insulation housing, each of the two rows of conductive terminal sets being disposed on two opposing sides of the tongue portion and having a plurality of conductive terminals, and each of the plurality of conductive terminals having contact portions disposed at the tongue portion and soldering portions protruded out the base portion.

The instant disclosure further provides an electrical connector, comprising: a metallic shell structure including a first shell defining a receiving space and having a port and an opening in communication with the receiving space, and at least one second shell covering an outer wall surface of the first shell, wherein at least one of the first shell and the second shell is formed with one single conductive contact portion or a plurality of conductive contact portions free from being parallel to one another around the port; an insulation housing disposed in the receiving space and having a base portion and a tongue portion extending from the base portion; a shielding plate disposed inside the insulation housing; and two rows of conductive terminal sets disposed on two sides of the insulation housing, each of the two rows of conductive terminal sets being disposed on two opposing sides of the tongue portion and having a plurality of conductive terminals, and each of the plurality of conductive terminals having contact portions disposed at the tongue portion and soldering portions protruded out the base portion.

The instant disclosure still provides an electrical connector, comprising: a metallic shell structure defining a receiving space and having a port and an opening in communication with the receiving space with a plurality of conductive contact portions free from being parallel to one another formed around the port; an insulation housing disposed in the receiving space of the metallic shell structure and comprising a base portion and a tongue portion extending from the base portion; a shielding plate disposed inside the insulation housing; and two rows of conductive terminal sets disposed on two sides of the insulation housing, each of the two rows of conductive terminal sets being disposed on two opposing sides of the tongue portion and comprising a plurality of conductive terminals, and each of the plurality of conductive terminals having contact portions disposed at the tongue portion and soldering portions protruded out the base portion.

In an embodiment, the electrical connector further comprises an insulation frame disposed around the port and engaged with the metallic shell structure by, for example, a concave-convex structure. In another embodiment, the insulation frame is an insulator, and the conductive contact portion protrudes from the insulation frame. In still another embodiment, the insulation frame is formed with a groove for receiving the conductive contact portion.

In an embodiment, the base portion is exposed from the opening, and the tongue portion is exposed from the port.

It can be known from the above that an electrical connector according to the instant disclosure employs a conductive contact portion that can be in contact with an external device as the electrical connector is assembled with the external device into a product. Therefore, a grounding effect is achieved, electromagnetic compatibility is improved, and the problem of RFI is diminished.

BRIEF DESCRIPTION OF THE DRAWINGS

The instant disclosure can be more fully understood by reading the following detailed description of the embodiments, with reference made to the accompanying drawings, wherein:

FIGS. 3' and 3" are schematic diagrams of other embodiments of FIG. 3;

DETAILED DESCRIPTION OF THE EMBODIMENTS

Figure 1:
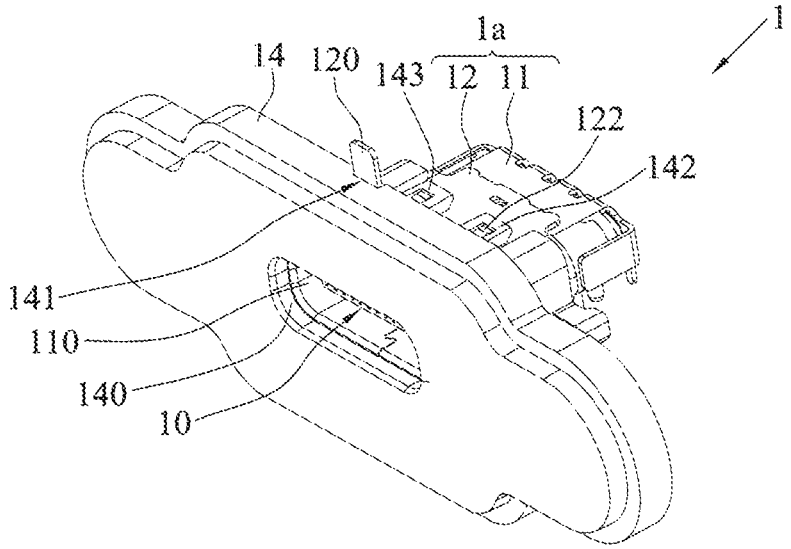
FIG. 1 is a three-dimensional schematic diagram of an electrical connector according to the instant disclosure.

The following illustrative embodiments are provided to illustrate the disclosure of the instant disclosure, these and other advantages and effects can be apparently understood by those in the art after reading the disclosure of this specification. The instant disclosure can also be performed or applied by other different embodiments. The details of the specification may be on the basis of different points and applications, and numerous modifications and variations can be devised without departing from the spirit of the instant disclosure.

It should be understood that the structures, proportions and sizes illustrated in the figures appended to the present specification are merely used for coping with the content of disclosure contained in the present specification, so as to enhance the understanding and perusal of a person skilled in the art. They shall not be viewed as limiting the implementable limitations of the present application, and do not bear any technical significance. Any modification of a structure, alterations of a proportion and adjustment of a structure should all fall within the scope of the disclosed technical content of the instant disclosure, without affecting the claimed effect and purpose to achieve. Meanwhile, the terms like "upper," "lower," "before," "after," "left," "right," "first" and "second" in the present specification are merely used for description, instead of limiting the implementable scope of the instant disclosure. Without substantially altering the technical content, the alteration of adjustment of any relationship can be regarded as fallen within the implementable scope of the instant disclosure.

FIGS. 1-4 are schematic diagrams of an electrical connector 1 according to the instant disclosure. The electrical connector 1 comprises an insulation housing 10, a metallic shell structure la, two rows of conductive terminal sets 13 and 13', an insulation frame 14, and a shielding plate 15.

In an embodiment, the electrical connector 1 is in the form of a universal serial bus (USB), particularly, a USB Type-C.

In an embodiment, the metallic shell structure la comprises a first shell 11 (i.e., an inner shell as shown) and at least one second shell 12 (i.e., an outer shell as shown), and the first shell 11 is formed with a receiving space S for the insulation housing 10 and the conductive terminal sets 13 and 13' to be received therein.

In an embodiment, the first shell 11 is a metallic shell, such as an iron shell, and is defined with a port 110 formed at a front side of the receiving space S and a downward facing opening 111 formed at a rear side of the receiving space S.

In an embodiment, the second shell 12 is a metallic shell, such as an iron shell, and covers an outer wall surface of the first shell 11.

In an embodiment, the second shell 12 has a conductive contact portion 120 (e.g., a metallic spring piece) extending from a periphery of the port 110, and a plurality of pins 121 are disposed on left and right sides of the second shell 12 extending downward, and are disposed at a front end and a rear end on two sides of the second shell 12 for installing the electrical connector 1 onto an electrical device (not shown).

Figure 2:
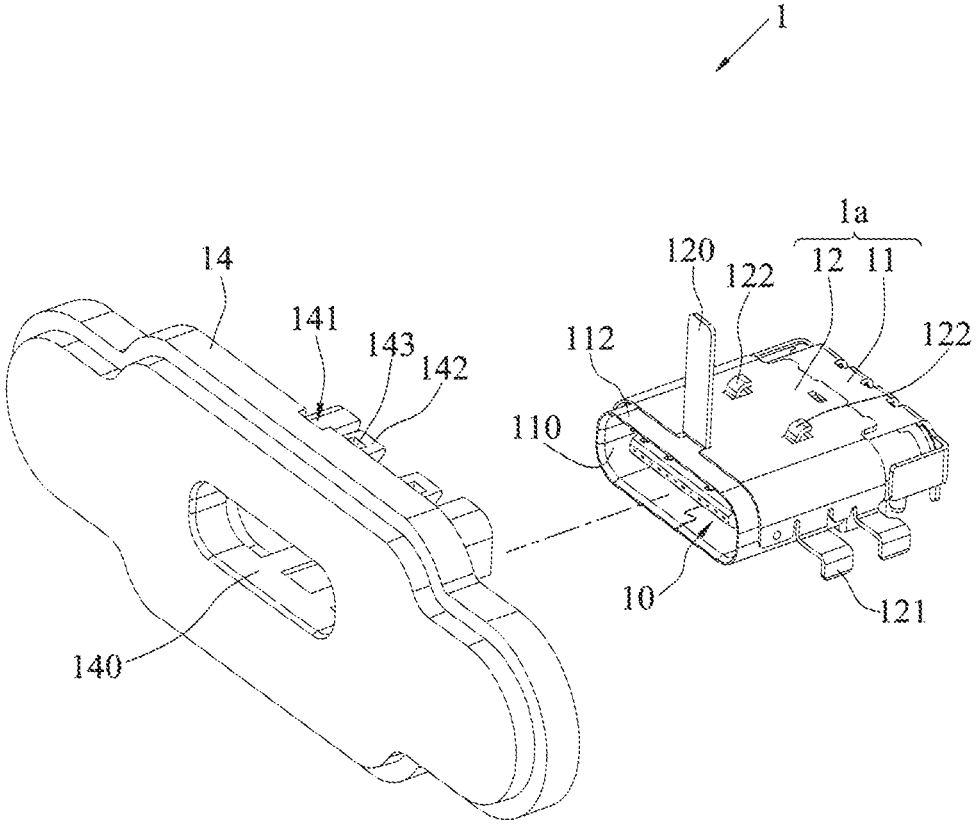
FIG. 2 is an exploded schematic view of the electrical connector shown in FIG. 1.

In an embodiment, the second shell 12 covers a portion of a surface of the first shell 11, such that the first shell 11 protrudes from a front side of the second shell 12, and thereby forming a placement part 112 on an outer surface at a front side of the first shell 11, as shown in FIG. 2. In other words, the first shell 11 defines the placement part 112 that protrudes from the second shell 12. In another embodiment, the second shell 12 may cover the entire surface of the first shell 11.

Figure 3:
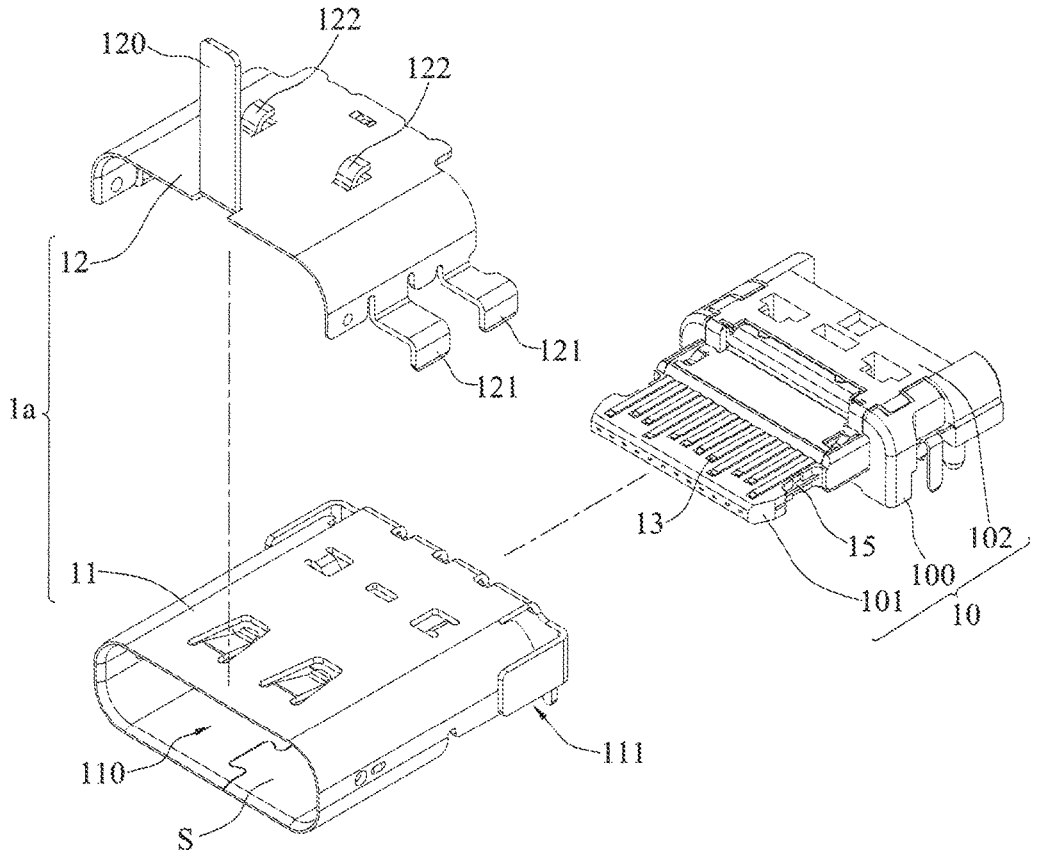
FIG. 3 is a partially exploded view of the electrical connector shown in FIG. 2.
Figure 3:
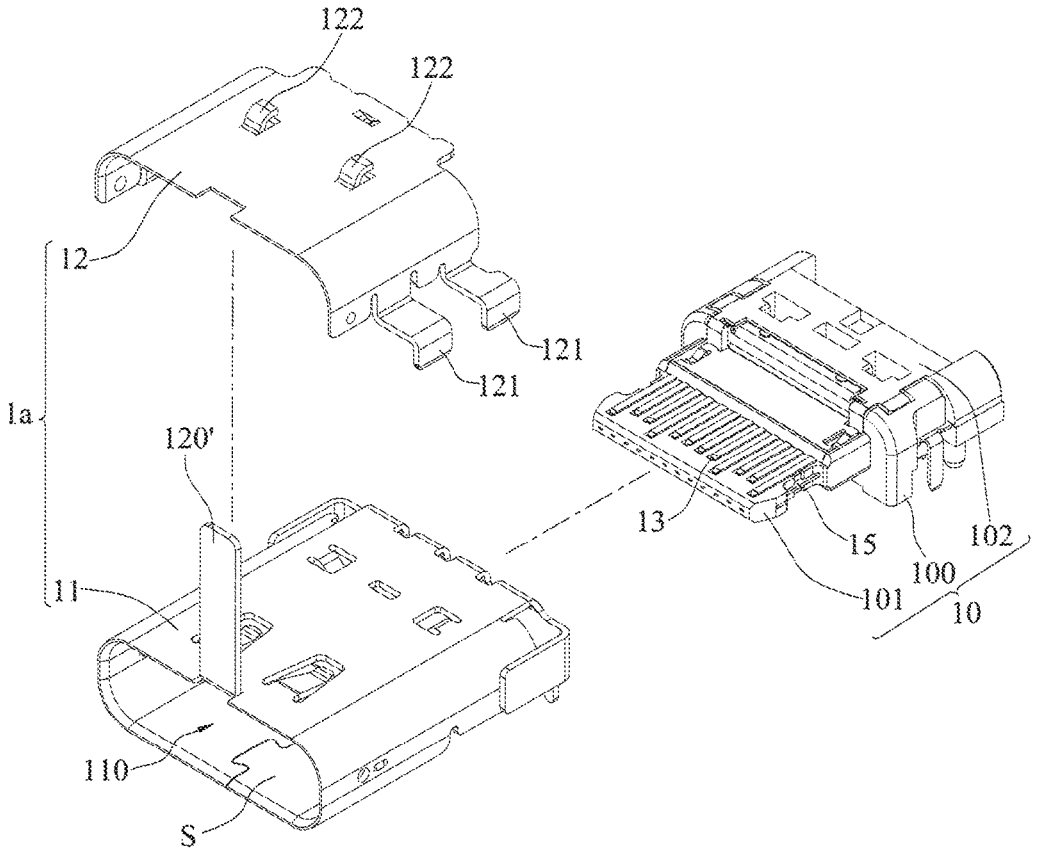

In yet another embodiment, the first shell 11 has a conductive contact portion 120' extending from a periphery of the port 110, as shown in FIG. 3'.

In further another embodiment, as shown in FIG. 3", the second shell 12 may have a plurality of conductive contact portions 120" that are not parallel to one another and extend from the periphery of the port 110. For example, the conductive contact portions 120" can be formed on different sides, such as upper and left sides, of the port 110. In another embodiment, the conductive contact portion 120" can be formed on the same side of the first shell 11 or on the same side of the second shell 12. Therefore, the conductive contact portion 120" cannot be parallel to one another in many ways, and are not limited to the ways shown in the drawings.

Figure 4:
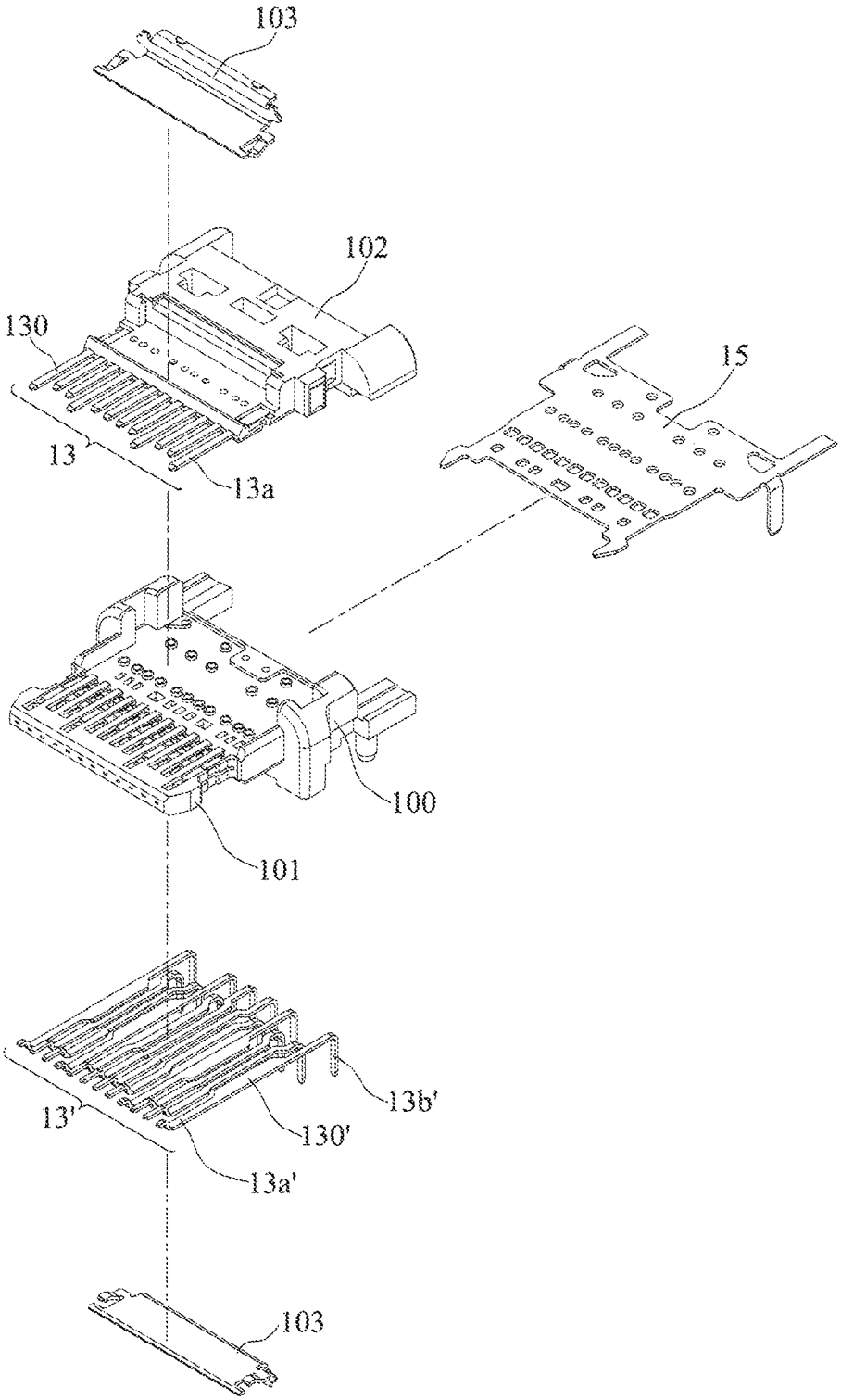
FIG. 4 is a partially exploded view of the electrical connector shown in FIG. 3.

The insulation housing 10 comprises a base portion 100, a tongue portion 101, an upper base portion 102 and two conductive strip members 103. As shown in FIG. 4, the tongue portion 101 extends from the base portion 100, and the base portion 100 and the upper base portion 102 protrude from a rear side of the first shell 11.

In an embodiment, the base portion 100 is received in the receiving space S of the first shell 11 and is near the opening 111. The tongue portion 101 is received in the receiving space S of the first shell 11 and is near the port 110. The tongue portion 101 is exposed from the port 110, and the base portion 100 and the upper base portion 102 are exposed from the opening 111.

The conductive terminal sets 13 and 13' comprise a plurality of conductive terminals 130 and 130' respectively as shown in FIG. 4, and are secured on upper and lower sides of the insulation housing 10 respectively. The conductive terminals 130 and 130' define contact portions 13*a* and 13*a'* disposed on the tongue portion 101 respectively. The conductive terminals 130 and 130' define soldering portions protruding from the rear side of the first shell 11 (the soldering portion 13*b'* of the conductive terminal 130' is shown in the drawing, while the soldering portion of the conductive terminal 130 is not shown). In an embodiment, the soldering portions are electrically connected to an electronic device (not shown).

In an embodiment, each of the conductive terminals 130 and 130' extend in a direction from the tongue portion 101 to the base portion 100, and bends and extends downward to be in the shape of a curved rod. In another embodiment, the contact portions 13*a* and 13*a'* are exposed from the port 110, and the soldering portions protrude from the opening 110.

In an embodiment, the conductive terminals 130 and 130' comprise ground terminals (Gnd), power source terminals (Power/VBUS) and reserved-for-future-use (RFU) terminals, and differential pair signal terminals installed, if required on demands.

The upper conductive terminal set 13 is molded with the upper base portion 102 to form a terminal module. The contact portions 13*a* of the upper conductive terminal set 13 are disposed on the tongue portion 101 as shown in FIG. 3. The lower conductive terminal set 13' extends from the base portion 100 and the tongue portion 101 and has the conductive strip members 103 disposed on the base portion 100 and the upper base portion 102.

The shielding plate 15 is disposed inside the base portion 100 and the tongue portion 101 of the insulation housing 10 as shown in FIGS. 3 and 4.

In an embodiment, the conductive terminal sets 13 and 13' are disposed on upper and lower sides of the tongue portion 101 respectively, and the shielding plate 15 is disposed between the upper conductive terminal set 13 and the lower conductive terminal set 13'.

The arrangement of the conductive terminals of a USB is common knowledge in the art, and the description of the definition and design of the conductive terminals thereby omitted.

The insulation frame 14 is disposed around the port 110 of the first shell 11.

In an embodiment, the insulation frame 14 has a port 140 for a front side of the first shell 11 to be inserted thereinto, as shown in FIGS. 1 and 2, allowing the insulation frame 14 to be disposed at the placement part 112. In another embodiment, the insulation frame 14 has a groove 141 for the conductive contact portion 120 disposed at the port 110 to be received therein.

In an embodiment, the insulation frame 14 is an insulator, and the conductive contact portion 120 protrudes from the insulation frame 14, as shown in FIG. 1. In another embodiment, the conductive contact portion 120 can be in no contact with (or in contact with) the insulation frame 14. In yet another embodiment, the insulation frame 14 is also a metallic body.

Figure 5:
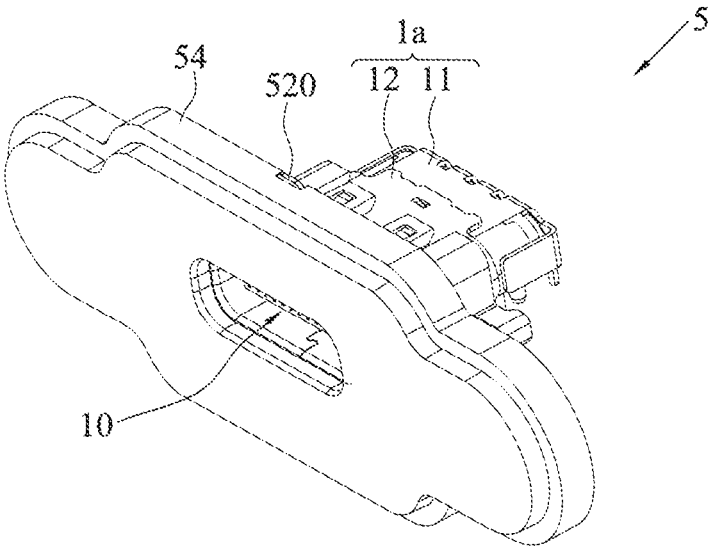
FIG. 5 is a three-dimensional schematic diagram of another embodiment of FIG. 1.

In an embodiment, as shown in FIG. 5, the conductive contact portion 520 does not protrude from the insulation frame 54, the insulation frame 54 is a metallic body, and the conductive contact portion 520 is in contact with the insulation frame 54. In another embodiment, the conductive contact portion 520 can also protrude from the metallic insulation frame 54.

The insulation frame 14 is engaged with the second shell 12, for example, by a concave-convex structure. Two positioning legs 142 extend from one side of the insulation frame 14, and each of the positioning legs 142 has a positioning hole 143 disposed thereon. An upper surface of the second shell 12 is pulled up (or punched) to form a plurality of protrusion parts 122 protruding outward (as shown in FIG. 2, the second shell 12 has two protrusion parts 122 on the upper surface thereof). The protrusion parts 122 are engaged with the positioning holes 143, allowing the insulation frame 14 to be engaged with the second shell 12. It is appreciated that there are various types of concave-convex structures, and they are not limited to the one described above (that is, the engagement of the positioning hole 143 with the protrusion part 122). The concave-convex structure can also allow the insulation frame 14 to be engaged with the first shell 11, when the second shell 12 is not installed.

In the electrical connector 1 according to the instant disclosure, the conductive contact portions 120, 120' and 120" protrude from the insulation frame 14, and can be in contact with an external device (not shown) after the electrical connector 1 is assembled with the external device to form a product. Therefore, a grounding effect is achieved, the EMC is improved, and the problem of RFI is diminished. As such, the electromagnetic interference waves of the product will not affect the operation of the electrical connector 1, and the electrical connector 1 has enough capability to resist the external interference.

As shown in FIG. 5, the electrical connector 5 has the conductive contact portion 520 to be in contact with a metallic insulation frame 54, such that the metallic insulation frame 54 can be in contact with the external device. Therefore, the grounding effect can also be achieved, and the EMC can also be improved.

The insulation frame 14, 54 and the second shell 12 (or the first shell 11), via the design of the concave-convex structure, is advantageous in the positioning and assembling of the insulation frame 14, 54.

The appearance of the insulation frame 14, 54 can be designed according to the structure of the external device, and is not limited to the one shown in the drawings.

In sum, an electrical connector according to the instant disclosure employs the conductive contact portions of the shell to improve the EMC and solve the problem of RFI.

The foregoing descriptions of the detailed embodiments are only illustrated to disclose the features and functions of the instant disclosure and not restrictive of the scope of the instant disclosure. It should be understood to those in the art that all modifications and variations according to the spirit and principle in the disclosure of the instant disclosure should fall within the scope of the appended claims.

What is claimed is:

1. An electrical connector, comprising:

a metallic shell structure defining a receiving space and having a port and an opening in communication with the receiving space, wherein a plurality of pins are disposed on the metallic shell structure and one single conductive contact portion is formed on an outside surface of the metallic shell structure;

an insulation housing disposed in the receiving space of the metallic shell structure and comprising a base portion and a tongue portion extending from the base portion;

an insulation frame disposed around the port;

a shielding plate disposed inside the insulation housing; and two rows of conductive terminal sets disposed on two sides of the insulation housing, each of the two rows of conductive terminal sets being disposed on two opposing sides of the tongue portion and comprising a plurality of conductive terminals, and each of the plurality of conductive terminals having contact portions disposed at the tongue portion and soldering portions protruded out the base portion.

2. The electrical connector of claim 1, wherein the conductive contact portion protrudes from the insulation frame.

3. The electrical connector of claim 1, wherein the insulation frame is formed with a groove for receiving the conductive contact portion.

4. The electrical connector of claim 1, wherein the insulation frame is engaged with the metallic shell structure.

5. The electrical connector of claim 4, wherein the insulation frame is engaged with the metallic shell structure by a concave structure or a convex structure.

6. An electrical connector, comprising:

a metallic shell structure including:

a first shell defining a receiving space and having a port and an opening in communication with the receiving space; and at least one second shell covering an outer wall surface of the first shell and having a plurality of pins, wherein an outside surface of at least one of the first shell and the second shell is formed with one single conductive contact portion around the port or a plurality of conductive contact portions free from being parallel to one another around the port;

an insulation housing disposed in the receiving space and comprising a base portion and a tongue portion extending from the base portion;

an insulation frame disposed around the port;

a shielding plate disposed inside the insulation housing; and two rows of conductive terminal sets disposed on two sides of the insulation housing, each of the two rows of conductive terminal sets being disposed on two opposing sides of the tongue portion and comprising a plurality of conductive terminals, and each of the plurality of conductive terminals having contact portions disposed at the tongue portion and soldering portions protruded out the base portion.

7. The electrical connector of claim 6, wherein the conductive contact portion protrudes from, or the plurality of conductive contact portions protrude from, the insulation frame.

8. The electrical connector of claim 6, wherein the insulation frame is formed with a groove for receiving the conductive contact portion.

9. The electrical connector of claim 6, wherein the insulation frame is engaged with the metallic shell structure.

10. The electrical connector of claim 9, wherein the insulation frame is engaged with the metallic shell structure by a concave structure or a convex structure.

11. An electrical connector, comprising:

a metallic shell structure defining a receiving space and having a port and an opening in communication with the receiving space, wherein a plurality of pins are disposed on the metallic shell structure and a plurality of conductive contact portions free from being parallel to one another are formed around the port on an outside surface of the metallic shell structure;

an insulation housing disposed in the receiving space of the metallic shell structure and comprising a base portion and a tongue portion extending from the base portion;

an insulation frame disposed around the port;

a shielding plate disposed inside the insulation housing; and two rows of conductive terminal sets disposed on two sides of the insulation housing, each of the two rows of conductive terminal sets being disposed on two opposing sides of the tongue portion and comprising a plurality of conductive terminals, and each of the plurality of conductive terminals having contact portions disposed at the tongue portion and soldering portions protruded out the base portion.

12. The electrical connector of claim 11, wherein the plurality of conductive contact portions protrude from the insulation frame.

13. The electrical connector of claim 11, wherein the insulation frame is formed with a groove for receiving the plurality of conductive contact portions.

14. The electrical connector of claim 11, wherein the insulation frame is engaged with the metallic shell structure.

15. The electrical connector of claim 14, wherein the insulation frame is engaged with the metallic shell structure by a concave structure or a convex structure.

* * * * *